US008809252B2

(12) United States Patent
Heppert et al.

(10) Patent No.: US 8,809,252 B2
(45) Date of Patent: Aug. 19, 2014

(54) COMPOSITION

(75) Inventors: Kai Heppert, Weinheim (DE); Stefan Frey, Darmstadt (DE); Ralf Wiedemann, Mira (IT); Ralf Hofsaess, Ludwigshafen (DE); Christian Schneeweiss, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 415 days.

(21) Appl. No.: 12/679,414

(22) PCT Filed: Sep. 26, 2008

(86) PCT No.: PCT/GB2008/003276

§ 371 (c)(1),
(2), (4) Date: Sep. 7, 2010

(87) PCT Pub. No.: WO2009/040545

PCT Pub. Date: Apr. 2, 2009

(65) Prior Publication Data

US 2010/0331230 A1 Dec. 30, 2010

(30) Foreign Application Priority Data

Sep. 26, 2007 (GB) ..... 0718777.6

(51) Int. Cl.

| | |
|---|---|
| ***C11D 17/00*** | (2006.01) |
| *C11D 3/39* | (2006.01) |
| *C11D 3/386* | (2006.01) |
| *C11D 3/50* | (2006.01) |

(52) U.S. Cl.

CPC ..... *C11D 17/0039* (2013.01); *C11D 3/3935* (2013.01); *C11D 3/38672* (2013.01); *C11D 3/505* (2013.01); *C11D 3/3905* (2013.01)

USPC ..... 510/376

(58) Field of Classification Search

CPC ..... C11D 17/0039; C11D 3/3935; C11D 3/38672; C11D 3/505; C11D 3/3905

USPC ..... 510/376

See application file for complete search history.

(56) References Cited

U.S. PATENT DOCUMENTS

| | | | | |
|---|---|---|---|---|
| 5,258,132 | A * | 11/1993 | Kamel et al. | 510/370 |
| 5,480,575 | A | 1/1996 | Altieri | |
| 5,902,781 | A * | 5/1999 | Painter | 510/220 |
| 6,093,343 | A | 7/2000 | Crombie | |
| 6,159,922 | A * | 12/2000 | Williams | 510/372 |
| 6,177,393 | B1 * | 1/2001 | McGregor et al. | 510/224 |
| 6,177,398 | B1 * | 1/2001 | McGregor et al. | 510/446 |
| 6,274,538 | B1 * | 8/2001 | Addison | 510/224 |
| 6,303,561 | B1 * | 10/2001 | Painter | 510/446 |
| 6,358,911 | B1 * | 3/2002 | Metzger-Groom | 510/446 |
| 6,391,845 | B1 * | 5/2002 | Speed et al. | 510/446 |
| 6,399,564 | B1 * | 6/2002 | Speed et al. | 510/446 |
| 6,451,754 | B1 * | 9/2002 | Rowland et al. | 510/446 |
| 6,462,007 | B1 * | 10/2002 | Pieroni et al. | 510/224 |
| 6,486,117 | B1 * | 11/2002 | Painter et al. | 510/446 |
| 6,544,943 | B1 * | 4/2003 | Ricci et al. | 510/446 |
| 6,544,944 | B1 * | 4/2003 | Ricci et al. | 510/446 |
| 6,548,473 | B1 * | 4/2003 | Jacques Kamiel Thoen et al. | 510/446 |
| 6,551,981 | B1 * | 4/2003 | Ricci et al. | 510/446 |
| 6,551,982 | B1 * | 4/2003 | Ricci et al. | 510/446 |
| 6,589,932 | B1 * | 7/2003 | Ricci et al. | 510/446 |
| 6,686,328 | B1 * | 2/2004 | Binder | 510/446 |
| 6,770,616 | B1 * | 8/2004 | McGowan et al. | 510/446 |
| 6,974,789 | B1 * | 12/2005 | Whitaker et al. | 510/294 |
| 2002/0045010 | A1 * | 4/2002 | Rohrbaugh et al. | 427/372.2 |
| 2002/0160930 | A1 * | 10/2002 | Emmerson et al. | 510/445 |

FOREIGN PATENT DOCUMENTS

| | | | |
|---|---|---|---|
| EP | 0141470 | A | 5/1985 |
| EP | 0141472 | A | 5/1985 |
| GB | 2428694 | A | 2/2007 |
| WO | 9421777 | A1 | 9/1994 |
| WO | 02066592 | A1 | 8/2002 |
| WO | 03093405 | A1 | 11/2003 |

* cited by examiner

*Primary Examiner* — Gregory Webb

(74) *Attorney, Agent, or Firm* — Norris McLaughlin & Marcus PA

(57) ABSTRACT

A particulate material comprising a bleach catalyst wherein the particles of the bleach catalyst have a coating and the weight ratio of the coating to the bleach catalyst is in the range of from 10-60 wt %. The particulate material exhibits good stability.

20 Claims, No Drawings

COMPOSITION

This is an application filed under 35 USC 371 of PCT/GB2008/003276.

This invention relates to a bleaching composition.

The use of bleaching catalysts for stain removal has been developed over recent years. In this regard Mn (II) or Mn (III) salts are active as bleach catalysts in compositions having bleach precursors such as percarbonate or perborate and optionally bleach activators such as TAED.

The shelf life of a product may be regarded as the period of time over which the product may be stored whilst retaining its required quality. A satisfactory shelf life is in many instances a crucial factor for the success of a commercial product. A product with a short shelf life generally dictates that the product is made in small batches and is rapidly sold to the consumer. It is also a concern to the owners of a brand with a short shelf life that the consumer uses the product within the shelf life otherwise the consumer may be inclined to change to a similar product of another brand. In contrast a similar product with a long shelf life may be made in larger batches, held as stock for a longer period of time and the period of time that a consumer stores the product is not of a great concern to the owners of a particular brand.

Indeed Mn (II) or Mn (III) salts suffer from disproportion or aerial oxidation to form Mn (IV) species (turning to $MnO_2$). This happens quickly in particular in an alkaline environment (e.g. an alkaline cleaning powder or tablet). Especially for Mn (II) salts which have light purple/pink colour this goes hand in hand with a colour change to brown. The resulting species are less active in bleaching processes.

WO 96/37593 teaches the protection of redox active substances by agglomeration of such substances with excipients. The redox active materials can be metal salts. The presented solution, however, has the downside of consuming more excipients (compared to the coating material consumed in the present invention) and has as a result still some redox active material on the surface of the granule which can interact with air or formulation ingredients. Furthermore upon abrasion such granules release redox substance containing dust which might react with the rest of the formulation.

Coating of particulate materials is already known. For example, GB-A-2428694, WO 03/093405 and WO 02/066592 teach the coating of bleach catalyst granules to improve stability thereof. It is also known to prepare bleach catalyst granules which are substantially free from easily oxidisable material and which includes a carrier material and a binder agent.

It is an object of the present invention to obviate/mitigate the problems outlined above and/or to further improve the stability of particulate material comprising a bleach catalyst.

According to a first aspect of the present invention there is provided a particulate material comprising a bleach catalyst wherein the particles of the bleach catalyst have a coating and the weight ratio of the coating to the bleach catalyst is in the range of from 10-60 wt %.

The particulate material of the invention demonstrates good stability.

With the use of a coating stability problems associated with the bleach catalysts have been found to be addressed. Thus the bleach catalysts can be incorporated into a detergent formulation without incurring any problems of stability/integrity. Detergent products made using these particles have been found to exhibit excellent storage stability. Additionally the presence of fines in the bleach catalyst is drastically reduced.

Without wishing to be bound by theory it is postulated that the coating forms a closed shell around bleach catalyst which not only creates a suitable pH environment (neutral to acidic) but also creates a barrier for detrimental species such as aerial oxygen.

The weight ratio of the coating to the bleach catalyst is in the range of from 10-60 wt % coating (hence 90-40 wt % bleach catalyst). More preferably the weight ratio is in the range of from 15-50 wt % and most preferably the weight ratio is in the range of from 20-40 wt % coating. The particles may further incorporate auxiliary materials, such as the usual detergent additives or fillers.

Preferably the pH of the composition used for coating is neutral or acidic and has a pH value<7, more preferably <5 (measured as a 1 wt % solution in water at room temperature).

The coating composition is preferably water soluble. This allows aqueous solutions of the coating material to be manufactured. Preferably aqueous solutions with concentrations of >20 wt % or >30 wt % coating material (at room temperature) may be prepared.

Preferred coating materials comprise a carboxylate/carboxylic moiety containing compound. Generally the coating is monomeric/polymeric carboxylate/carboxylic compound or a derivative thereof [hereafter referred to generally as a carboxylate]. Alternative preferred coatings include polyols.

Suitable types of carboxylate include monomeric carboxylates/carboxylic acids such as; citric acid/citrate, maleic acid/maleate and derivatives thereof. Suitable types of polymeric carboxylate for coating include carboxylates/carboxylic acids such as polyacrylates/polyacrylic acid and derivatives/copolymers thereof. Suitable polymeric polyols for coating include hydrolysed polyacetates (wherein a portion of the acetate moieties are hydrolysed to hydroxyl moieties, e.g. to polyvinyl alcohol) and derivatives thereof. Other suitable types of polyols include sugars, starch and starch derivatives, cellulose derivatives, oligosaccharides (e.g. dextrins) and derivatives thereof.

The coating may comprise a mixture of the above. Optionally other adjunct materials form part of the coating such as dyes, fillers, antioxidants, plasticisers.

Generally the bleach catalyst particle has an initial particle size (before coating) of less than 2000 μm, more preferably less than 1200 μm and most preferably less than 1000 μm.

The coated particulate material is preferably formed in a process comprising a fluid bed in which the crystals are coated by spray application of coating material. The particulate may become agglomerated in the coating process. It is preferred that the coated particle of the invention comprises an agglomerate of individual particles.

Preferably the bleach catalyst is a manganese compound such as a Mn (II) or Mn (III) salt. Preferred examples of Mn salts include carboxylate salts, e.g. acetate salts.

The particulate is preferably for use in an automatic washing detergent formulation e.g. such as a dishwasher detergent/additive or a laundry detergent/additive. Thus according to a second aspect of the present invention there is provided a solid detergent composition comprising a bleaching catalyst wherein the particles of the bleach catalyst have a coating and the weight ratio of the coating to the bleach catalyst is in the range of from 10-60 wt %.

The detergent composition may comprise a powder, a compressed particulate body or an injection moulded body. Most preferably the composition comprises a tabletted composition. The detergent composition may be packaged in a water soluble material such as a water soluble film.

Generally the particulate is incorporated into the detergent/additive at a level of 100 to 3000 ppm (wherein this figure is the amount of Mn by weight incorporated in the formula), more preferably at a level of 200 to 2000 ppm and most preferably at a level of 250 to 1200 ppm.

The composition may further incorporate auxiliary materials, such as the usual detergent additives or fillers, e.g. one or more of the following agents; bleach, bleach activator, corrosion inhibition agent, fragrance, builder, co-builder, surfactant, binding agent, dye, acidity modifying agent, dispersion aid, or enzyme.

Preferred bleaches are percarbonate, perborate. Preferred bleach activators include TAED.

The invention is now further described with reference to the following non-limiting Examples. Further examples within the scope of the invention will be apparent to the person skilled in the art.

EXAMPLE 1

Coating Manganese (II) Acetate with Citric Acid

Coating of manganese (II) acetate particles with citric acid was carried out in a 2-step process. This was conducted in a Glatt fluid bed machine with a starting weight of manganese (II) acetate of 20 kg.

In a first step the manganese (II) acetate was dried in the fluidized bed unit until reaching the product temperature of 60° C.

The process conditions were:

| | |
|---|---|
| Inlet air-Volume: | 900 m3/h |
| Inlet air-Temperature: | 140° C. |
| Product-Temperature: | 60-70° C. |
| Outlet air-Temperature: | 44-53° C. |

In a second step the manganese (II) acetate was coated with citric acid using a 40% aqueous solution of citric acid (30 kg). The spray rate of coating solution was 20 kg/h.

The process conditions were as follows:

| | |
|---|---|
| Inlet air-Volume: | 900 m3/h |
| Inlet air-Temperature: | 160° C. |
| Product-Temperature: | 60-80° C. |
| Outlet air-Temperature: | 63-77° C. |
| Spray air-Pressure: | 3.0 bar |
| Spray air-Temperature: | RT (room temperature) |

At the end of step 2 the coated particles were allowed to reach ambient temperature and are unloaded from the coating device. The full coating experiment took 1.5 hours.

From this experiment samples of core particles coated with 10, 20 30 and 40% by weight of coating material were picked.

EXAMPLE 2

Coating Manganese (II) Acetate with Polyvinyl Alcohol & Citric Acid

The protocol of Example 1 was repeated using an aqueous solution comprised of 10 wt % polyvinyl alcohol (a short molecular chain length polyvinyl alcohol with a degree of hydrolysis of 85%, commercially available as Moviol 3-85 ex Kuraray Europe) and 15 wt % citric acid.

From this experiment samples of core particles coated with 20 and 30% by weight of coating material were picked.

EXAMPLE 3

Stability Analysis

The following formulations were used to measure the stability of the coated particles.

TABLE 1

| Raw materials | Comparative wt % | Formula 1 wt % | Formula 2 wt % |
|---|---|---|---|
| Sodium Tripolyphosphate | 47.0 | 47.0 | 47.0 |
| Sodium Carbonate | 20.0 | 20.0 | 20.0 |
| Sodium Percarbonate | 10.5 | 10.5 | 10.5 |
| Sulfonated Polycarboxylate Sodium Salt | 5.0 | 5.0 | 5.0 |
| Polyethylene glycol | 4.5 | 4.5 | 4.5 |
| TAED | 3.0 | 3.0 | 3.0 |
| Sodium Bicarbonate | 3.0 | 3.0 | 3.0 |
| Fatty Alcohol Polyglycolether | 2.0 | 2.0 | 2.0 |
| Lactose | 1.0 | 1.0 | 1.0 |
| Microcrystalline Cellulose | 1.0 | 1.0 | 1.0 |
| Protease | 1.0 | 1.0 | 1.0 |
| Amylase | 0.5 | 0.5 | 0.5 |
| Citric Acid | 0.5 | 0.5 | 0.5 |
| Silver Corrosion Inhibitor | 0.5 | 0.5 | 0.5 |
| Manganese Acetate | 0.5 (Uncoated) | 0.5 (Ex. 1) | 0.5 (Ex. 2) |

The compositions were examined visually after storage at 30° C. and 70% humidity, wrapped in a foil having an MVTR of 0.3 g/m$^2$/day).

The coated manganese particles did not show significant chemical degradation over the test period. The uncoated particles showed discolouration.

TABLE 2

| Formulation | Comparative | Formula 1 | Formula 2 |
|---|---|---|---|
| Start | None | None | None |
| 3 weeks | Brown marks | None | None |
| 6 weeks | Brown points | None | Light brown points |
| 9 weeks | Dark brown points | None | Light brown points |
| 12 weeks | Dark brown points | None | Light brown points |

The invention claimed is:

1. A coated particulate material comprising a core and a coating material, wherein the core comprises a bleach catalyst selected from a Mn(II) and/or Mn(III) compound, and the coating material which forms a shell around the core which coating material comprises a) a polyol; or b) a monomeric/polymeric carboxylate/carboxylic compound or a derivative thereof, selected from the group consisting of citric acid/citrate and derivatives thereof, maleic acid/maleate and derivatives thereof, and polyacrylate/polyacrylic acid and derivatives/copolymers thereof.

2. A particulate material according to claim 1, wherein the pH of the material used for the coating material is <7.

3. A particulate material according to claim 1, wherein the polyol comprises a polymeric polyol.

4. A particulate material according to claim 1, wherein the polyol comprises hydrolysed polyacetates, sugars, starch and starch derivatives, cellulose derivatives, oligosaccharides and derivatives thereof.

5. A particulate material according to claim 1, wherein the bleach catalyst has an initial particle size (before coating) of less than 2000 μm.

6. A particulate material according to claim 1 which comprises an agglomerate of individual bleach catalyst particles.

7. A solid detergent composition comprising a particulate material according to claim 1.

8. A solid detergent composition according to claim 7, wherein the composition comprises a tabletted composition.

9. A particulate material according to claim 1 wherein the coating material comprises a polyol.

10. A particulate material according to claim 5, wherein the bleach catalyst has an initial particle size (before coating) of less than 1200 μm.

11. A particulate material according to claim 10, wherein the bleach catalyst has an initial particle size (before coating) of less than 1000 μm.

12. A particulate material according to claim 1, wherein the weight ratio of the coating material to the bleach catalyst is in the range of from 10-60% wt.

13. A particulate material according to claim 1, wherein core consists essentially of Mn(II) and/or Mn(III) compounds.

14. A particulate material according to claim 13, wherein the core consists of Mn(II) and/or Mn(III) compounds.

15. A particulate material according to claim 1, wherein the coating material consists essentially of a material selected from: a) a polyol; or b) a monomeric/polymeric carboxylate/carboxylic compound or a derivative thereof, which is selected from the group consisting of citric acid/citrate and derivatives thereof, maleic acid/maleate and derivatives thereof, and polyacrylate/polyacrylic acid and derivatives/copolymers thereof; or a mixture thereof.

16. A particulate material according to claim 15, wherein the coating material consists of a material selected from: a) a polyol; or b) a monomeric/polymeric carboxylate/carboxylic compound or a derivative thereof, which is selected from the group consisting of citric acid/citrate and derivatives thereof, maleic acid/maleate and derivatives thereof, and polyacrylate/polyacrylic acid and derivatives/copolymers thereof; or a mixture thereof.

17. A particulate material according to claim 1 consisting of:

a core comprising a bleach catalyst selected from the Mn(II) and/or Mn(III) compound, and a coating material which forms a closed shell around the core which coating material is selected from: a) a polyol; or b) a monomeric/polymeric carboxylate/carboxylic compound or a derivative thereof, selected from the group consisting of citric acid/citrate and derivatives thereof, maleic acid/maleate and derivatives thereof, and polyacrylate/polyacrylic acid and derivatives/copolymers thereof; or a mixture thereof.

18. A coated particle comprising:

a core comprising a bleach catalyst selected from a Mn(II) and/or Mn(III) compound, and;

a coating material which forms a shell around the core which includes a coating material selected from: a) a polyol; or b) a monomeric/polymeric carboxylate/carboxylic compound or a derivative thereof, selected from the group consisting of citric acid/citrate and derivatives thereof, maleic acid/maleate and derivatives thereof, and polyacrylate/polyacrylic acid and derivatives/copolymers thereof; or a mixture thereof thereof.

19. A coated particle according to claim 18 wherein:

the core consists essentially of a bleach catalyst selected from a Mn(II) and/or Mn(III) compound.

20. A coated particle according to claim 18 wherein:

the coating material consists essentially of a) a polyol; or b) a monomeric/polymeric carboxylate/carboxylic compound or a derivative thereof, selected from the group consisting of citric acid/citrate and derivatives thereof, maleic acid/maleate and derivatives thereof, and polyacrylate/polyacrylic acid and derivatives/copolymers thereof; or a mixture thereof.

* * * * *